US006443261B1

(12) United States Patent
Gibson et al.

(10) Patent No.: US 6,443,261 B1
(45) Date of Patent: Sep. 3, 2002

(54) STEP STOOL

(75) Inventors: William R. Gibson, Kent, OH (US); Enrique R. Giner, Huntington Woods, MI (US)

(73) Assignee: Cosco Management, Inc., Wilmington, DE (US)

( * ) Notice: Subject to any disclaimer, the term of this patent is extended or adjusted under 35 U.S.C. 154(b) by 56 days.

(21) Appl. No.: 09/637,042

(22) Filed: Aug. 11, 2000

Related U.S. Application Data

(60) Provisional application No. 60/148,867, filed on Aug. 13, 1999.

(51) Int. Cl.[7] ..... E06C 1/00

(52) U.S. Cl. ..... 182/161; 182/104; 182/129; 182/165

(58) Field of Search ..... 182/20, 22, 129, 182/104, 156, 161, 163, 180.1; 403/325, 328, 330, DIG. 4

(56) References Cited

U.S. PATENT DOCUMENTS

| | | | | | |
|---|---|---|---|---|---|
| 867,754 | A | | 10/1907 | Randall | |
| 2,470,053 | A | | 5/1949 | Salisbury | |
| 2,509,206 | A | * | 5/1950 | Buckner | 182/156 |
| 3,259,207 | A | * | 7/1966 | Schoeffler | 182/161 |
| 3,801,054 | A | * | 4/1974 | Glowacki | 248/188.7 |
| 3,801,208 | A | * | 4/1974 | Bourgraf et al. | 403/95 |
| 4,042,305 | A | * | 8/1977 | Vincent | 403/328 |
| 4,216,844 | A | * | 8/1980 | Klafs | 182/104 |
| 4,235,449 | A | | 11/1980 | Tarran | |
| 4,253,546 | A | | 3/1981 | Uchida | |
| 4,286,353 | A | * | 9/1981 | Roche | 16/143 |
| 4,415,180 | A | * | 11/1983 | Payne, Jr. | 280/650 |
| 4,448,282 | A | | 5/1984 | Giezendanner | |
| 4,474,264 | A | * | 10/1984 | Krause | 182/163 |
| 4,485,892 | A | | 12/1984 | Maloney et al. | |
| 4,607,973 | A | * | 8/1986 | Wilke | 403/328 X |
| 4,733,882 | A | * | 3/1988 | Kassai | 280/47.37 |
| 4,934,485 | A | | 6/1990 | Purkapile | |
| 5,127,762 | A | * | 7/1992 | Havlovitz | 403/298 |
| D387,878 | S | | 12/1997 | Jacques | |
| 5,722,507 | A | | 3/1998 | Kain | |
| 5,937,968 | A | | 8/1999 | Gibson et al. | |
| 6,000,175 | A | * | 12/1999 | Gale et al. | 52/63 |
| 6,000,497 | A | * | 12/1999 | Kain et al. | 182/129 |
| 6,026,933 | A | | 2/2000 | King et al. | |
| 6,039,149 | A | * | 3/2000 | Bedja et al. | 182/20 |
| 6,155,740 | A | * | 12/2000 | Hartenstine | 403/102 |

* cited by examiner

*Primary Examiner*—Bruce A. Lev
(74) *Attorney, Agent, or Firm*—Barnes & Thornburg

(57) ABSTRACT

A step stool includes a frame including a front leg and a rear leg movable relative to the front leg and a leg lock coupled to the frame and arranged to retain the rear leg in a fixed position relative to the front leg upon movement of the rear leg to an opened use position lying at an angle to the front leg. The leg lock includes a button receiver coupled to the front leg and a button supported for movement on the rear leg from a released position arranged to disengage the button receiver to allow relative movement of the front and rear legs and a locked position engaged to the button receiver to retain the rear leg in the fixed position.

24 Claims, 5 Drawing Sheets

STEP STOOL

This application claims priority under 35 U.S.C. Section 119(e) to U.S. Provisional Application No. 60/148,867, filed Aug. 13, 1999, which is expressly incorporated by reference herein.

BACKGROUND AND SUMMARY OF THE INVENTION

The present invention relates to a step stool, and particularly, to a folding step stool having legs that fold between an opened use position and a collapsed storage position. More particularly, the present invention relates to a folding step stool having a latch for locking the step stool in the opened use position.

Step stools are frequently used around homes and businesses. Step stools must provide stability for the user when in an opened position. Further, step stools will ideally collapse to assume a storage position.

Step stools having legs that fold to assume both an opened use position and a collapsed storage position are known. See, for example, U.S. Pat. No. 4,485,892 to Maloney et al., U.S. Pat. No. 5,722,507 to J. Kain, U.S. Pat. No. 5,937,968 to Gibson et al., U.S. Pat. No. 6,000,497 to Kain et al., and U.S. Pat. No. 6,026,933 to King et al., all of which are hereby incorporated by reference herewith.

According to the present invention, a step stool includes a frame having a front leg and a rear leg movable relative to the front leg. The step stool also includes a leg lock coupled to the frame and arranged to retain the rear leg in a fixed position relative to the front leg upon movement of the rear leg to an opened use position. The leg lock includes a button supported for movement on the rear leg and a button receiver coupled to the front leg. The button is movable to a locked position engaging the button receiver and a released position disengaging the button receiver.

In preferred embodiments, the leg lock includes a button housing coupled to an upper end of the rear leg and formed to include a chamber containing a spring-loaded button arranged to protrude from the chamber through an opening formed in the button housing. The button receiver includes a pair of plates mounted on the front leg to provide a space therebetween for receiving the button housing herein when the rear leg is moved to assume its opened use position.

One of the button receiver plates is formed to include an aperture located and sized to receive the protruding outer end of the spring-biased button therein to establish the locked position of the button after movement of the rear leg to assume its opened use position. To unlock the rear leg so that the foldable step stool can be collapsed, a user pushes the button into the chamber in the button housing and against the force generated by the button-biasing spring located in the button housing to move the button out of the aperture formed in the button receiver plate, thereby establishing the released position of the button. The step stool can now be folded to move the rear leg to a "collapsed" opsition alongside the front leg.

The leg lock further includes a leg link having one end pivotably coupled to the rear leg at a point just below the button housing and another end pivotably coupled to one of the button receiver plates. The button housing mounted on the upper end of the rear leg swings out and away from the button receiver mounted on the front leg after movement of the button to a released position disengaging the aperture formed in the button receiver and movement of the rear leg to the opened use position.

Additional features of the invention will become apparent to those skilled in the art upon consideration of the following detailed description of preferred embodiments exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
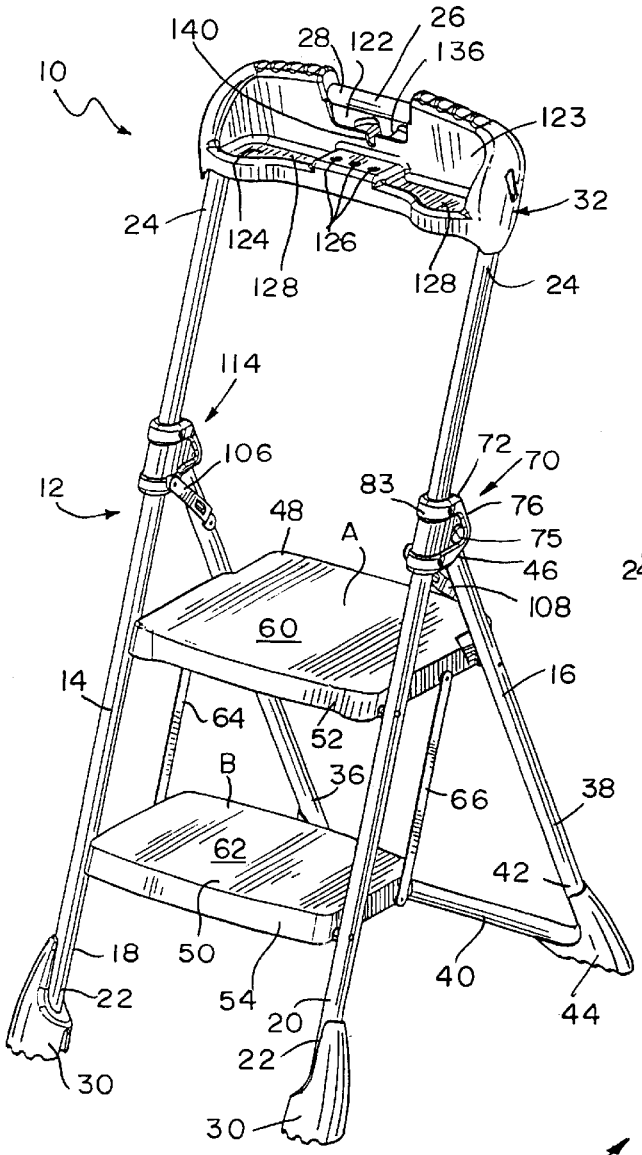
FIG. 1 is a perspective view of a step stool in an opened use position showing the step stool including a front leg, a rear leg coupled to the front leg by a leg lock located at the top of each of the two upright leg members included in the U-shaped rear leg, a top step pivotably coupled to the front and rear legs, a bottom step pivotably coupled to the front leg and supported by a pair of step links coupled to the top step, and a small utility tray coupled to a top end of the front leg.
Figure 2:
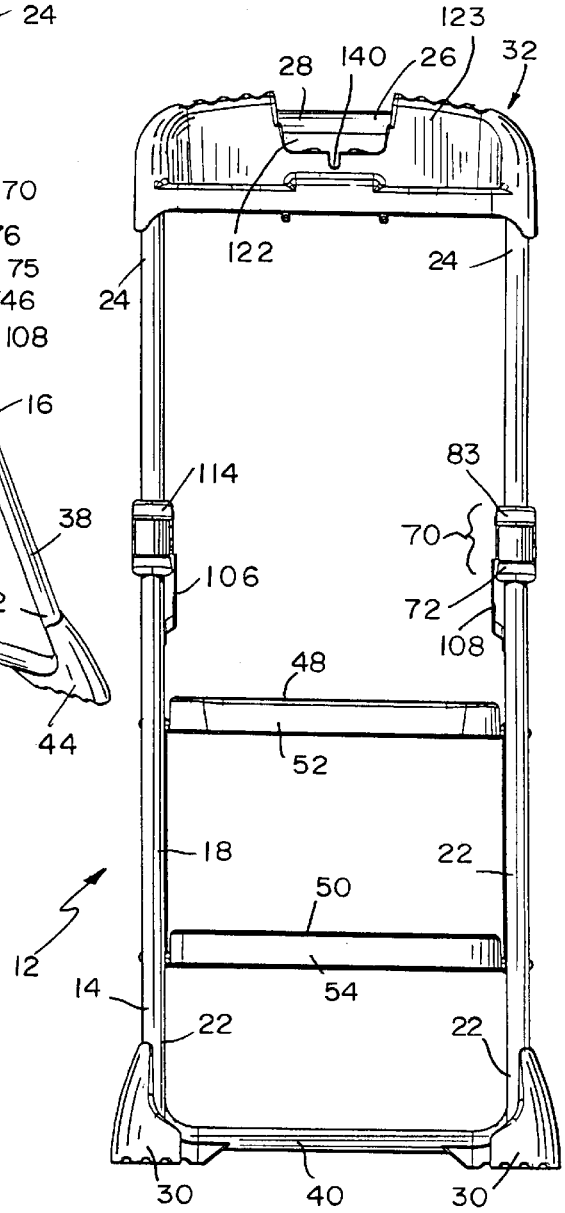
FIG. 2 is a front elevation view of the step stool of FIG. 1.
Figure 5:
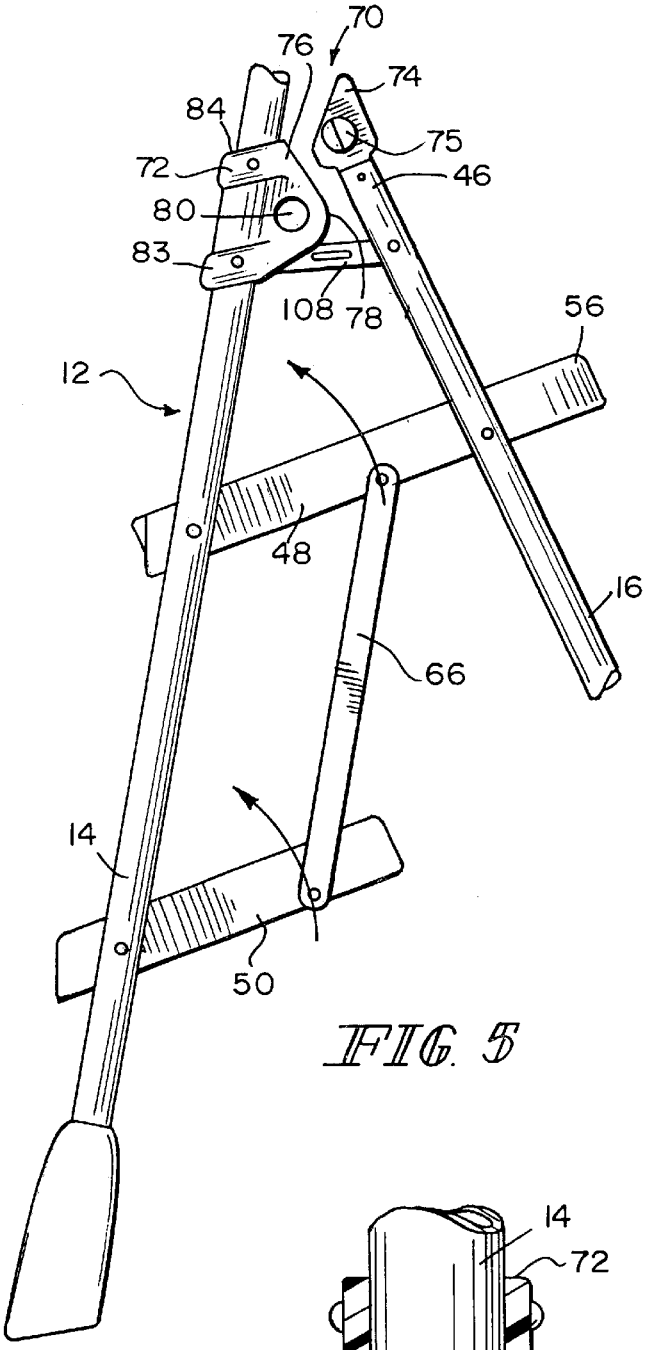
FIG. 5 is right side elevation view of the step stool of FIG. 1, with portions broken away, showing the step stool in a partially collapsed position and the leg lock in an unlocked position, and further showing a button receiver coupled to the front leg, a button protruding through an opening formed in a "trapezoid-shaped" button housing coupled to an upper end of the rear leg, and a leg link having one end pivotably coupled to the rear leg and an opposite end pivotably coupled to the button receiver.
Figure 6:
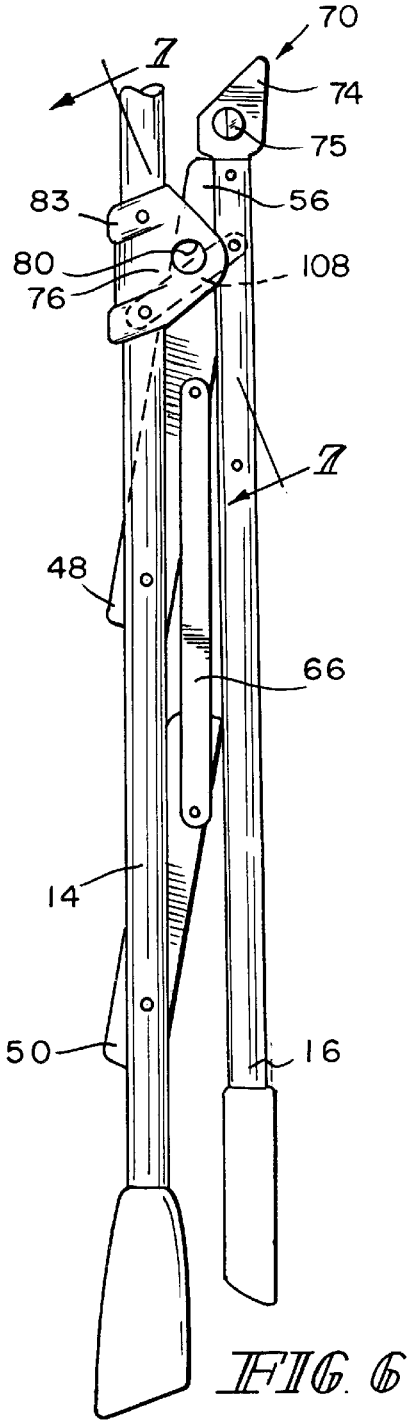
FIG. 6 is a right side elevation view similar to FIG. 5 showing the step stool in a collapsed storage position.

A foldable step stool 10 is configured to move between an opened use position shown in FIGS. 1–4 and a collapsed storage position shown in FIG. 6. As shown in FIG. 1, step stool 10 includes a frame 12 having a front leg 14 and a rear leg 16 and a leg lock 70 configured to retain rear leg 16 in a fixed position relative to front leg 14 upon movement of rear leg 16 to the opened use position. As shown best in FIGS. 5 and 10, leg lock 70 includes a button 75 carried in a button housing 74 mounted on an upper end 46 of rear leg 16 and a button receiver 72 formed to include an aperture 80 located and sized to receive an outer end 96 of button 75 therein to lock rear leg 16 to front leg 14 (as shown in FIGS. 1–4 and 8) upon movement of rear leg 16 15 to assume the opened use position.

The front leg 14 of frame 12 is U-shaped and includes opposite front leg members 18, 20 including bottom ends 22 and opposite top ends 24, a handle portion 26 defined at least in part by a central segment 28 extending between front leg members 18, 20, and a pair of stabilizer feet 30 coupled to bottom ends 22 of front leg members 18, 20. Front and rear legs 14, 16 of frame 12 are preferably constructed of tubular alloy, although a wide variety of suitable materials may be used.

Rear leg 16 is substantially U-shaped and includes first and second rear leg members 36, 38, a central portion 40 extending between bottom ends 42 of leg members 36, 38, and a pair of stabilizer feet 44. Top free ends 46 are positioned to lie opposite to bottom ends 42.

As shown in FIG. 5, top and bottom steps 48, 50 of step stool 10 are pivotably coupled to and extend between front leg members 18, 20 and are spaced-apart from utility tray 32. Top step 48 is positioned to lie spaced-apart from handle portion 26 and bottom step 50 is positioned to lie between top step 48 and bottom ends 22 of front leg 14. Top and bottom steps 48, 50, have front ends 52, 54 and rear ends 56, 58, respectively. Front ends 52, 54 of top and bottom steps 48, 50, respectively, are pivotably coupled to front leg 14 and rear end 56 of top step 48 is pivotably coupled to rear leg 16.

Referring now to FIG. 1, top step 48 includes a step surface 60 which has a surface area A that is greater than a surface area B of step surface 62 of bottom step 50. Top step 48 is pivotably coupled to rear leg 16 and step surface 62 of bottom step 50 faces top step 48. Although the illustrated embodiment includes only one bottom step 50 beneath top step 48, it is within the scope of the disclosure for additional steps to be provided.

Figure 3:
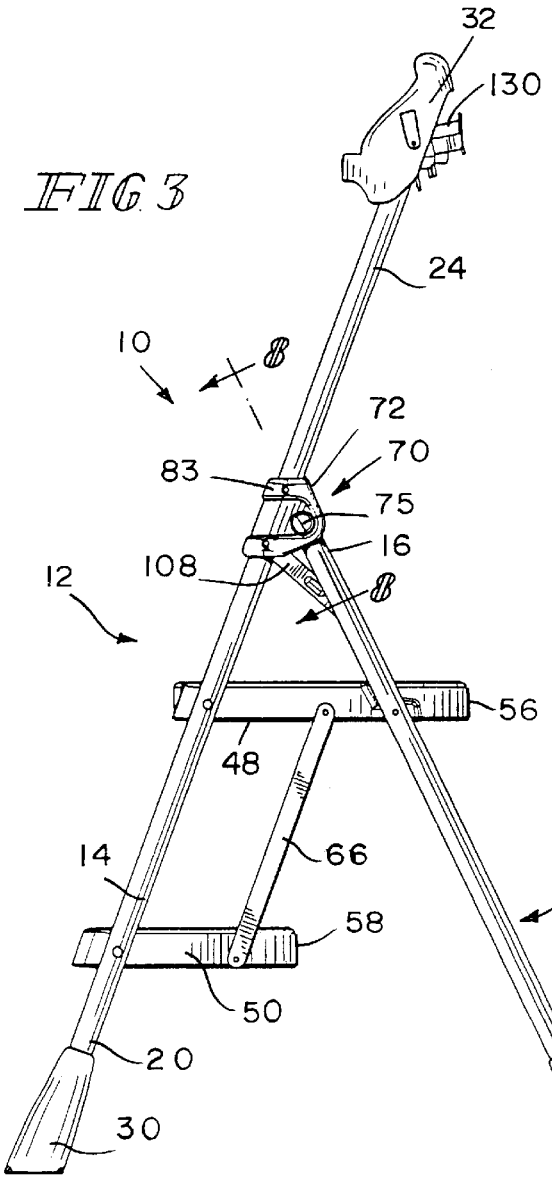
FIG. 3 is a right side elevation view of the step stool of FIG. 1 showing a button receiver coupled to the front leg at a point above the top step (as also shown in FIG. 5) and a button contained in a button housing coupled to the rear leg (as also shown in FIGS. 5 and 10) arranged to extend into an aperture formed in the button receiver to lock the rear leg to the front leg (as also shown in FIG. 8)

Step links 64, 66 are provided between top step 48 and bottom step 50 to maintain a substantially parallel relationship therebetween and to control the folding of bottom step 50 and top step 48 as the remainder of step stool 10 is moved between an opened use position and a closed storage position. Step links 64, 66 are substantially parallel to front leg 14 and are pivotably coupled at opposing ends to each of steps 48, 50. As shown in FIG. 3, top and bottom steps 48, 50 are substantially parallel to the ground or other supporting surface when step stool 10 is in the opened use position.

Referring to FIGS. 1, 5, 6, and 8–11, leg lock 70 couples rear leg 16 to front leg 14 in a locked position which is the opened use position, and when uncoupled, permits the front and rear legs 14, 16 to be positioned in the closed storage position. Leg lock 70 includes button receiver 72 coupled to front leg 14 and button housing 74 having button 75 is coupled to top free end 46 of rear leg 16. The button receiver 72 has a first plate 76 having an edge 78 and formed to include an aperture 80 sized to receive button 75 therethrough. Button receiver 72 also has second plate 82, which is arranged to lie in a spaced-apart parallel relation to first plate 76. Button receiver 72 further includes leg grip 83 having shoulder 84. Leg grip 83 is coupled to front leg 14 and both first plate 76 and second plate 82 to fix first and second plates 76, 82 in a spaced-apart parallel relation to one another to define a button space 85 therebetween.

Button housing 74 has a chamber 86 having an opening 88 as shown, for example, in FIGS. 8–11. The button 75 is mounted in the chamber 86 to extend through opening 88. The button housing 74 is sized to lie in the button space 85 when rear leg 16 is positioned to lie in the opened use position.

Button 75 has an inner end 90 positioned to lie in chamber 86 formed in button housing 74. The inner end 90 has a lip 92 which limits the movement of button 75 through opening 88 in chamber 86, thereby holding at least a portion of inner end 90 of button 75 in chamber 86 when a force is generated against button 75 by a compression spring 94. Inner end 90 of button 75 is positioned to lie in button space 85 upon movement of rear leg 16 to the opened use position. Button 75 also has an outer end 96 positioned to extend through opening 88 of the chamber 86, the outer end 96 being positioned to lie outside button space 85 upon movement of rear leg 16 to the opened use position.

A compression spring 94 is positioned to lie in button housing 74. The first end 98 of compression spring 94 is positioned against outer end 96 of button 75 and the second end 100 of compression spring 94 is positioned against a spring mount 102. The compression spring 94 is used to yieldably urge at least the outer end 96 of button 75 through opening 88 of chamber 86. The compression spring 94 also yieldably urges at least a portion of outer end 96 of button 75 through aperture 80 of first plate 76 upon movement of the rear leg 16 to the opened use position. When button 75 is positioned to lie in aperture 80 and extends at least partially therethrough, rear leg 16 and front leg 14 are locked, and step stool 10 is in the opened use position.

Figure 10:
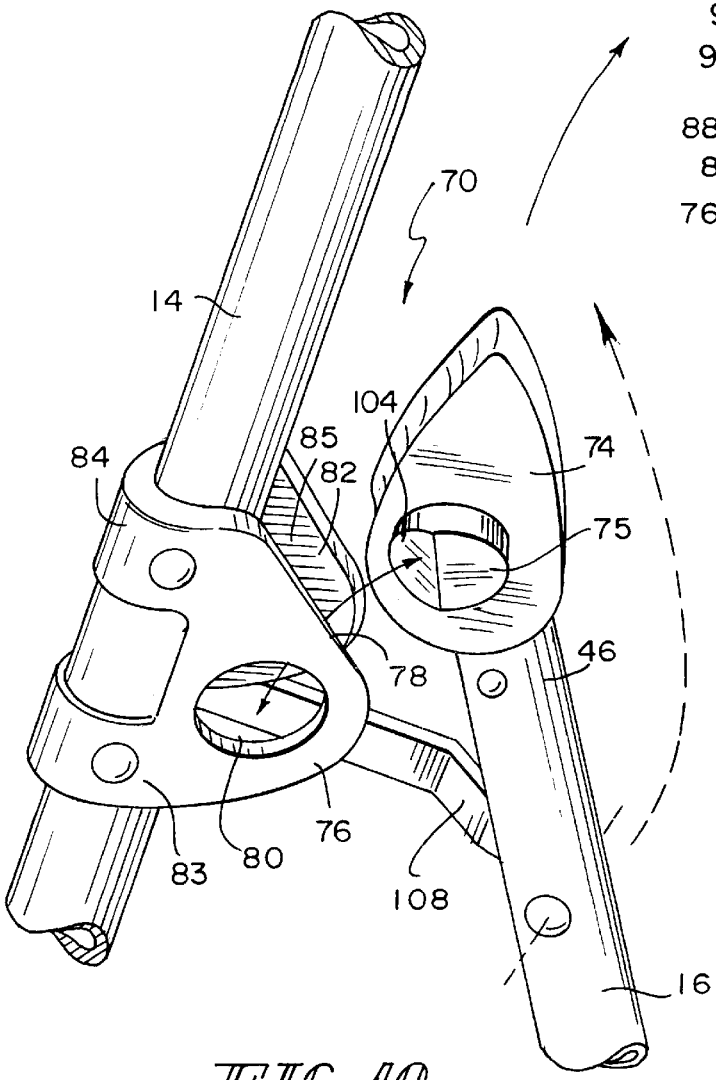
FIG. 10 is a perspective view of the button receiver showing a ramp formed on the outer end of the button and the button positioned to "snap" into the aperture-formed button receiver.

The outer end 96 of button 75 is formed to include a ramp 104 as shown best in FIG. 10. When rear leg 16 is moved to assume the opened use position, ramp 104 of button 75 is arranged to contact edge 78 and at least a portion of first plate 76, and outer end 96 of button 75 is moved against compression spring 94 to a retracted position to retract outer end 96 of button 75 temporarily into chamber 86 as rear leg 16 is moved toward the opened use position. Button 75 is held in the retracted position outside aperture 80 temporarily during the movement of rear leg 16 to the opened use position. Such retraction does not block movement of button 75 under force generated by compression spring 94. That is, when button 75 is positioned in alignment with aperture 80 upon movement of rear leg 16 to the opened use position, outer end 96 of button 75 is released via compression spring 94 and at least a portion of outer end 96 of button 75 extends through aperture 80 of first plate 76 to hold rear leg 16 in a locked position in relation to front leg 14, thereby forming the opened use position.

The leg lock 70 also includes leg links 106, 108. Leg links 106, 108 have first ends 110 pivotably coupled to rear leg 16 and second ends 112 pivotably coupled to leg grip 83 of button receiver 72 to control movement of top free end 46 of rear leg 16 relative to front leg 14 so that top free end 46 of rear leg 16 swings out and away from front leg 14 after button 75 is released out of aperture 80 of button receiver 72 and top free end 46 of rear leg 16 is released from its locked position in relation to front leg 14.

The step stool 10 has leg lock 70 positioned on one side of the frame 12 (for example, as shown in FIGS. 1–11, the left side). The opposing front leg member 18 and rear leg member 36 also contact one another when leg lock 70 is in the locked position, i.e., the opened use position. Opposing front leg member 18 has a housing receiver 114 and a closed housing (not shown). Housing receiver 114 has a housing space (not shown) sized to receive a closed housing (not shown), and is similar to button receiver 72, but has no aperture. Closed housing is connected to the top free end 46 of rear leg member 36, and is similar to button housing 74, but has no button, opening, compression spring, and the like. Front leg member 18 is pivotably connected to rear leg member 36 via leg link 106. When rear leg 16 is positioned in the opened use position, closed housing is positioned to lie inside of housing space, and against front leg member 18, in a manner similar to that described for positioning rear leg 16 and front leg 14 in the opened use position via leg lock 70. It is within the scope of this disclosure to position a leg lock 70 on either side of frame 12 or on both sides of frame 12.

Figure 8:
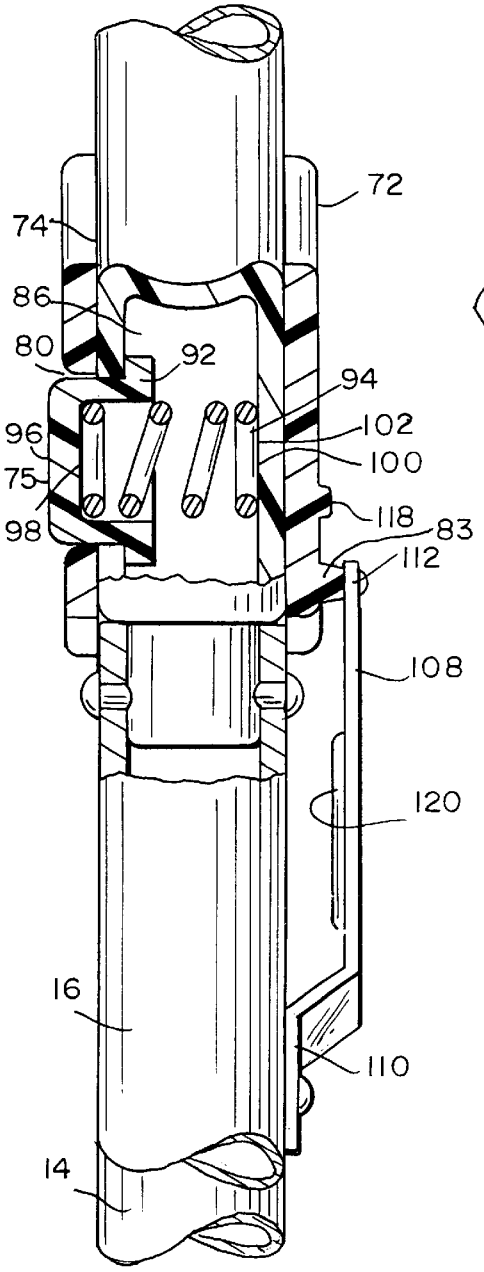
FIG. 8 is a cross-sectional view taken along line 8—8 of FIG. 3 showing the button biased by the spring contained in the chamber formed in the button housing to protrude through the aperture formed in one of the button receiver plates to lock the rear leg to the front leg.
Figure 9:
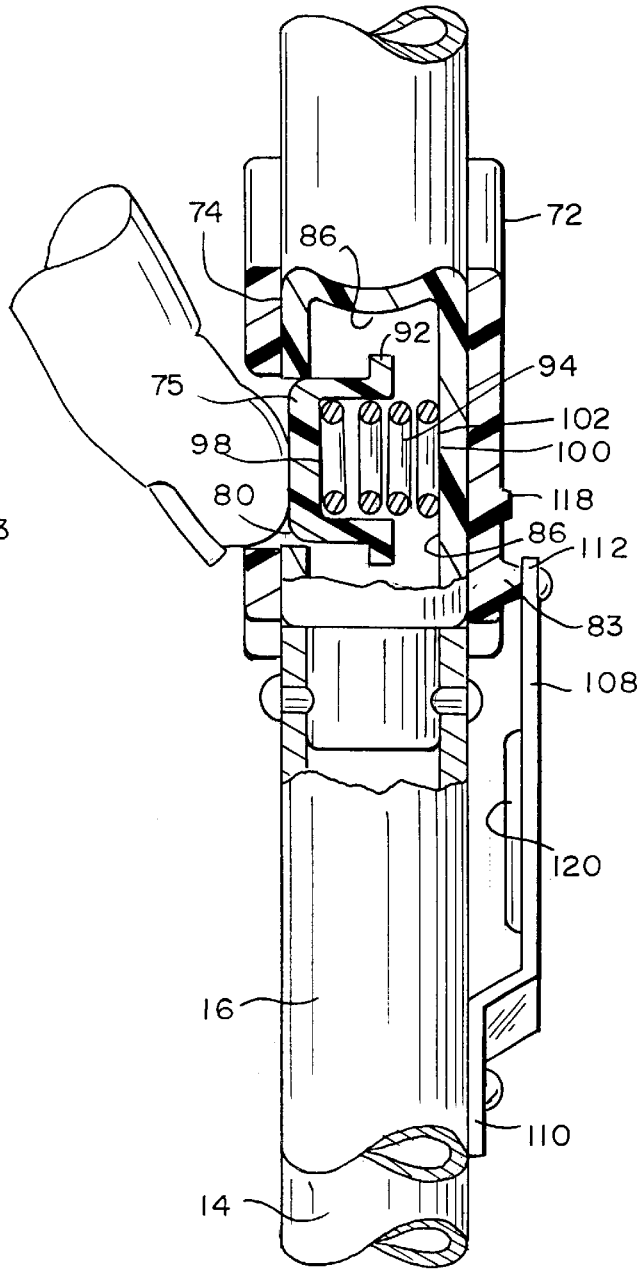
FIG. 9 is a view similar to FIG. 8 showing the button being pushed by a user to withdraw the outer end of the spring-loaded button from the aperture formed in the button receiver to unlock the rear leg from the front leg.

As shown in FIG. 8, when frame 12 is in the opened use position and leg lock 70 is in the locked position, rear leg 16 is prevented from pivoting toward front leg 14. Rear leg 16 is prevented from moving away from front leg 14 into a hyperextended position (not shown). It is within the scope of this disclosure that leg lock 70, such as button receiver 72 and button housing 74 having button 75, could be reversed to perform the same task of positioning the frame 12 in the locked position and opened use position.

The leg lock 70 is arranged to retain rear leg 16 in a fixed position relative to front leg 14, upon movement of rear leg 16 to an opened use position wherein rear leg 16 lies at an angle to front leg 14. The button 75, in a released position, is arranged to disengage button receiver 72 to allow relative movement of front and rear legs 14, 16. The button 75, in a locked position is engaged to the button receiver 72 to retain rear leg 16 in a fixed position.

Figure 7:
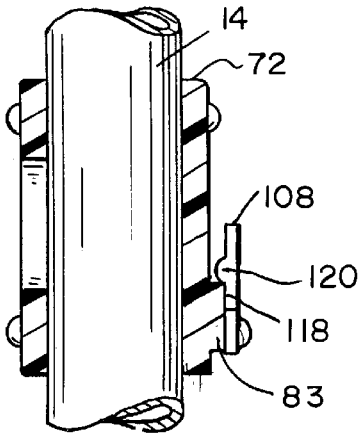
FIG. 7 is a cross-sectional view taken along lines 7—7 of FIG. 6 showing the button receiver coupled to the front leg and formed to include a first detent and the leg link including a second detent positioned to lie over the first detent to hold the step stool in the storage position.

Optionally, as illustrated in FIG. 7, button receiver 72 further includes first detent 118 for engaging second detent 120 of leg link 108 to releasably lock step stool 10 in the closed storage position. As leg link 108 swings from the opened use position, as shown in FIG. 3 to the closed storage position, as shown in FIG. 6, second detent 120 of leg link 108 travels over button receiver 72 until second detent 120 rides over first detent 118 to lock step stool 10 in the closed storage position. To release step stool 10 from the locked and closed storage position, leg link 108 is flexed to provide clearance between second and first detents 120, 118. Second detent 120 may also be disengaged from first detent 118 by pulling on rear leg 16 or pushing downwardly on top step 48 to force second detent 120 to ride back over first detent 118. Button receiver 72 further include shoulders 84 spacing leg link 108 apart from button receiver 72 to provide clearance between button receiver 72 and second detent 120. It is within the scope of this disclosure that leg link 108 could include a shoulder (not shown) or that a separate washer (not shown) could serve to space apart leg link 108 from button receiver 72.

Figure 4:
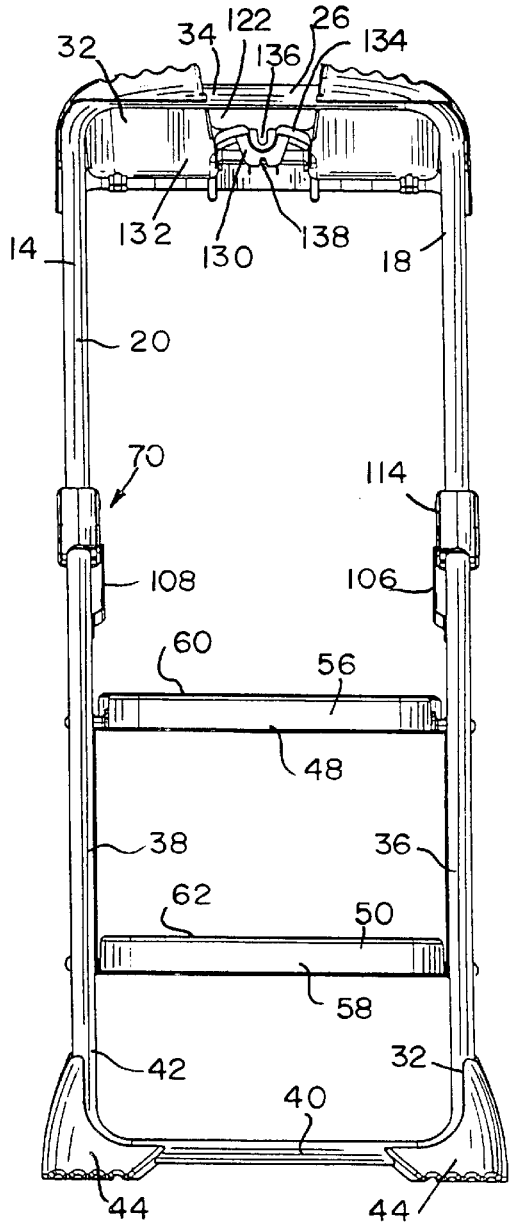
FIG. 4 is a rear elevation view of the step stool of FIG. 1 showing the two button receivers mounted on the front leg and positioned to lie above the top step.

Referring now to FIGS. 1–4, utility tray 32 is coupled to handle portion 26 of frame 12. Handle portion 26 includes a central segment 28 that extends through an aperture 122 in utility tray 26 and serves as a handle or gripping section for user to carry or maneuver step stool 10. Utility tray 26 includes a front side 123 and a tray surface 124, holes 126, and compartments 128 sized to receive tools, beverage cans or cups, nuts, bolts, screws, pens, rulers, and other objects therein. Utility tray 32 also includes a bracket 130 coupled to rear side 132 of utility tray 32 that includes a substantially arch-shaped surface 134 for receiving a bucket handle (not shown). Bracket 130 further includes a cavity 136 for inserting a user's finger to facilitate removal of a bucket handle. Bracket 130 also includes a slot 138, as shown in FIG. 4, for hanging step stool 10 on a hook, nail, or the like for storage. Utility tray 32 further includes a notch 140 sized to receive an extension cord (not shown). In illustrated embodiments, utility tray 32 is coupled to front leg 14 on top ends 24 of front leg members 18, 20 to provide a user convenient access to utility tray 32. In alternative embodiments (not shown), utility tray 32 may be located at any position above or below top step 48. Utility tray 32 may include a wide variety of apertures and compartments, paper towel holders, or may be formed as a generally flat surface.

In a method of use, illustrated in FIGS. 6, 5, 10, 11, and 1–4, the frame 12 of step stool 10 is moved from the closed storage position (FIG. 6) to the opened use position (FIGS. 1–4). A bottom portion of rear leg 16 is pulled away from a bottom portion of front leg 14, as shown in FIG. 5. This movement causes leg links 106, 108 to pivotably move button housing 74 with button 75 which is positioned on top free end 46 of rear leg 16 toward button receiver 72 coupled to front leg 14 (FIG. 10).

Figure 11:
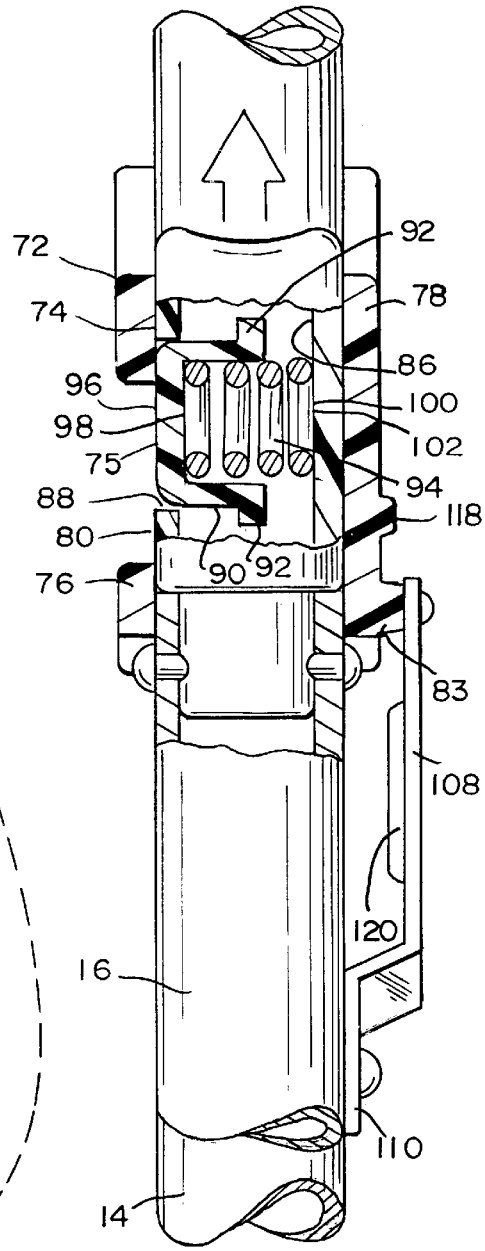
FIG. 11 is a view similar to FIG. 9 showing movement of the button and the button receiver during movement of the step stool between the opened use and closed storage positions.

When at least a portion of button housing 74 on rear leg 16 is pivotably moved into button space 84 and ramp 104 of outer end 96 of button 75 is positioned against edge 78 and at least a portion of first plate 76, button 75 is retracted via compression spring 94 to move into chamber 86 formed in button housing 74, as shown in FIG. 11. As button housing 74 is moved further into button space 85 by pivotable movement of top free end 46 of rear leg 16 toward front leg 14, button housing 74 and button 75 are received within button space 85, and when button 75 is aligned with aperture 80 in first plate 76 of button receiver 72, at least a portion of the outer end 96 of button 75 is moved under force generated by the compression spring 94 through the aperture 80 in the first plate 76 of the button receiver 72. When at least a portion of outer end 96 of button 75 extends through aperture 80, leg lock 70 is in the locked position and rear leg 16 is retained in the opened use position.

To fold step stool 10 from the opened use position, as shown in FIGS. 1–3, 5–6 and 9–10, the locked position of leg lock 70 is released by a user moving button 75 into chamber 86 and simultaneously lifting rear end 56 of top step 48. When these actions occur, button 75 is moved out of alignment with aperture 80 and is moved into button space 85 in the retracted position. As rear leg 16 is pivotably moved and swung outward and away from front leg 14, button housing 74 moves out of and away from button space 85 of button receiver 72, and step links 64, 66 lift rear end 58 of bottom step 50, keeping top and bottom steps 48,50 substantially parallel with one another throughout the folding motion. As the user continues to lift upward on rear end 56 of top step 48, step links 64, 66 draw rear end 58 of bottom step 50 closer to first leg 14 until top and bottom steps 48, 50 are substantially parallel to first leg 14. During folding, rear leg 16 is drawn closer to front leg 14 due to the pivotable coupling of leg links 106, 108 on front and rear legs 14, 16 and top step 48 to rear leg 16. When step stool 10 is collapsed in a position for storage, as shown in FIG. 6, rear leg 16 is substantially parallel to front leg 14, and step stool 10 is in its closed storage position.

Although the invention has been described in detail with reference to preferred embodiments, variations and modifications exist within the scope and spirit of the invention as described and defined in the following claims.

What is claimed is:

1. A step stool comprising a frame including a front leg and a rear leg movable relative to the front leg, a step on the frame, and a leg lock coupled to the frame and arranged to retain the rear leg in a fixed position relative to the front leg upon movement of the rear leg to an opened use position lying at an angle to the front leg, the leg lock including a button receiver coupled to the front leg and a button supported for movement on the rear leg from a released position arranged to disengage the button receiver to allow relative movement of the front and rear legs and a locked position engaged to the button receiver to retain the rear leg in the fixed position.

2. The step stool of claim 1, wherein the button receiver includes a first plate formed to include an aperture and the button lies in the aperture upon movement to the locked position.

3. The step stool of claim 2, wherein the button receiver includes a second plate arranged to lie in spaced-apart parallel relation to the first plate and a leg grip coupled to the front leg and the first and second plates to fix the first and second plates in spaced-apart parallel relation to one another to define a button space therebetween and the button is supported on the rear leg to lie inside the button space upon movement of the rear leg to the opened use position and to lie outside the button space upon movement of the rear leg away from the opened use position.

4. The step stool of claim 3, wherein the leg lock further includes a housing coupled to an upper end of the rear leg and formed to include a chamber having an opening and the button is mounted in the chamber to extend through the opening and the housing is sized to lie in the button space upon movement of the rear leg to the opened use position.

5. The step stool of claim 3, wherein the first plate is formed to include an edge, the button includes an inner end positioned to lie in the button space upon movement of the rear leg to the opened use position and an outer end positioned to lie outside the button space upon movement of the rear leg to the opened use position, and the button includes a ramp located on the outer end and arranged to contact the edge of the first plate during movement of the rear leg to the opened use position to position the outer end of the button in the button space and in alignment with the aperture formed in the first plate to facilitate movement of the outer end of the button through the aperture to assume a position outside of the button space upon movement of the rear leg to the opened use position.

6. The step stool of claim 2, wherein the leg lock further includes a housing formed to include a chamber having an opening and the button is mounted in the chamber to extend through the opening and through the aperture formed in the first plate upon movement of the rear leg to the opened use position.

7. The step stool of claim 6, wherein the housing is coupled to an upper end of the rear leg.

8. The step stool of claim 6, wherein the leg lock further includes a compression spring positioned to lie in the housing and arranged to yieldably urge the button through the opening of the chamber and a lip located on the button and arranged to limit movement of the button through the opening of the chamber.

9. The step stool of claim 6, wherein the button includes an inner end positioned to lie in the chamber formed in the housing and an outer end positioned to extend through the opening of the chamber and formed to include a ramp arranged to contact a portion of the first plate to retract the outer end of the button temporarily into the chamber as the rear leg is moved toward the opened use position and release the outer end of the button upon movement of the rear leg to the opened use position and alignment of the outer end of the button with the aperture formed in the first plate.

10. The step stool of claim 2, wherein the leg lock further includes a compression spring arranged to yieldably urge the button through the aperture in the first plate upon movement of the rear leg to the opened use position.

11. The step stool of claim 10, wherein the button is formed to include a ramp arranged to contact a portion of the first plate to move the button against the compression spring to a retracted position outside the aperture temporarily during movement of the rear leg to the opened use position without blocking movement of the button under a force generated by the compression spring to a position extending into the aperture upon movement of the rear leg to the opened use position.

12. The step stool of claim 1, wherein the leg lock further includes a leg link having one end pivotably coupled to the rear leg and another end pivotably coupled to the button receiver to control movement of an upper end of the rear leg relative to the front leg so that the upper end swings out and away from the front leg after movement of the button to the released position.

13. The step stool of claim 12, wherein the button receiver includes a first plate formed to include an aperture adapted to receive a portion of the button therein upon movement of the button to the locked position and a leg grip coupled to the first plate and to the front leg and another end of the leg link is pivotably coupled to the leg grip.

14. The step stool of claim 1, wherein the leg lock further includes a housing coupled to the rear leg and formed to include a chamber and the button is mounted in the chamber for movement between the released and locked position.

15. The step stool of claim 14, wherein the housing is coupled to an upper end of the rear leg.

16. The step stool of claim 14, wherein the leg lock further includes a compression spring positioned to lie in the housing and arranged to urge the button to assume the locked position upon movement of the rear leg to the opened use position.

17. The step stool of claim 16, wherein the leg lock further includes a lip located on the button and arranged to limit movement of the button relative to the housing under a force generated by the compression spring.

18. A step stool comprising a frame including a front leg and a rear leg movable relative to the front leg, a step on the frame, a button housing coupled to an upper end of the rear leg and formed to include a chamber, a spring-biased button arranged to protrude from the chamber through an opening formed in the button housing, and a button receiver coupled to the front leg and formed to include an aperture located and sized to receive a protruding outer end of the spring-biased button therein to retain the rear leg in a fixed position relative to the front leg upon movement of the rear leg to an opened use position.

19. The step stool of claim 18, wherein the button receiver includes a first plate and the aperture is formed in the first plate.

20. The step stool of claim 19, wherein the button receiver includes a second plate arranged to lie in spaced-apart parallel relation to the first plate and a leg grip coupled to the front leg and the first and second plates to fix the first and second plates in spaced-apart parallel relation to one another to define a button space therebetween and the button is supported on the rear leg to lie inside the button space upon movement of the rear leg to the opened use position and to lie outside the button space upon movement of the rear leg away from the opened use position.

21. The step stool of claim 19, wherein the first plate is formed to include an edge, the button includes an inner end positioned to lie in the button space upon movement of the rear leg to the opened use position and an outer end positioned to lie outside the button space upon movement of the rear leg to the opened use position, and the button includes a ramp located on the outer end and arranged to contact the edge of the first plate during movement of the rear leg to the opened use position to position the outer end of the button in the button space and in alignment with the aperture formed in the first plate to facilitate movement of the outer end of the button through the aperture to assume a position outside of the button space upon movement of the rear leg to the opened use position.

22. The step stool of claim 19, wherein the button includes an inner end positioned to lie in the chamber formed in the housing and an outer end positioned to extend through the opening of the chamber and formed to include a ramp arranged to contact a portion of the first plate to retract the outer end of the button temporarily into the chamber as the rear leg is moved toward the opened use position and release the outer end of the button upon movement of the rear leg to the opened use position and alignment of the outer end of the button with the aperture formed in the first plate.

23. The step stool of claim 18, further comprising a leg link having one end pivotably coupled to the rear leg and another end pivotably coupled to the button receiver to control movement of the upper end of the rear leg relative to the front leg so that the upper end swings out and away from the front leg after movement of the button to a released position disengaging the aperture formed in the button receiver.

24. A step stool comprising a frame including a front leg and a rear leg movable relative to the front leg, a step on the frame, a button receiver coupled to the front leg, a button, and means for supporting the button on an upper end of the rear leg for movement between a locked position engaged to the button receiver to retain the rear leg in a fixed position relative to the front leg and to locate the upper end of the rear leg in a first position in close proximity to the button receiver and a released position arranged to disengage the button receiver to release the rear leg for movement relative to the front leg to locate the upper end of the rear leg in a second position separated and away from the button receiver.

* * * * *